United States Patent [19]

Hantack et al.

[11] 4,002,419

[45] Jan. 11, 1977

[54] DIRECT BURNER IGNITION SYSTEM

[75] Inventors: Melvin E. Hantack, St. Louis; Paul D. Frazier, West Plains, both of Mo.

[73] Assignee: Eaton Corporation, Cleveland, Ohio

[22] Filed: Feb. 26, 1975

[21] Appl. No.: 553,342

[52] U.S. Cl. ..... 431/67

[51] Int. Cl.[2] ..... F23H 5/14

[58] Field of Search ..... 431/66, 67, 254; 317/98

[56] References Cited

UNITED STATES PATENTS

| | | | |
|---|---|---|---|
| 3,137,339 | 6/1964 | Kading | 431/66 |
| 3,609,072 | 9/1971 | Willson | 431/66 |
| 3,870,457 | 3/1975 | Perl | 431/66 |
| 3,871,814 | 3/1975 | Das et al. | 431/66 |

*Primary Examiner*—Edward G. Favors
*Attorney, Agent, or Firm*—Teagno & Toddy

[57] ABSTRACT

A direct ignition system for a fuel burner of the type having an igniter, which is mounted proximate to a burner, connected electrically in series with the fuel valve actuator. The system utilizes a voltage sensitive thermal switch which electrically bypasses the fuel valve actuator until a predetermined voltage has been applied to the switch and the igniter for a period of time sufficient to heat the igniter to the ignition temperature of the fuel. When the igniter has reached the required ignition temperature, the thermal switch opens permitting actuation of the fuel valve which allows fuel to flow to the burner.

7 Claims, 6 Drawing Figures

DIRECT BURNER IGNITION SYSTEM

BACKGROUND OF THE INVENTION

1. Field of the Invention

This invention relates generally to fuel ignition systems for valve controlled burners, and more particularly to direct ignition systems that use an electrical resistance igniter element in conjunction with a fuel valve and a thermal switch to prevent fuel flow to the burner until the igniter element reaches the fuel ignition temperature.

2. Description of the Prior Art

Fuel burner ignition devices generally comprise two categories, i.e., indirect and direct ignition systems. The indirect ignition systems usually involve a pilot flame which impinges on a thermocouple. As long as the flame continuously heats the thermocouple, current flows through the actuating coil for the fuel supply valve. If the thermocouple is properly positioned with respect to the pilot flame, the current flow will be sufficient to actuate the supply valve and permit fuel flow to the burner. The fuel is then ignited by the pilot flame. One inherent disadvantage of such a system is the criticalness in positioning the thermocouple with respect to the pilot flame. If the thermocouple is not positioned so that it will be properly heated by the pilot flame, the fuel supply valve will not operate. Another disadvantage of such systems is that the pilot flame can be diverted away from the thermocouple or completely extinguished by an air draft. When this occurs, the fuel supply valve becomes inoperable, preventing any fuel flow to the burner. And lastly, these ignition systems waste a significant amount of fuel since a pilot flame must be burning at all times.

Some direct ignition systems utilize electrical sparks to ignite the fuel flowing from the burner. Electrical time delay circuits are usually used in conjunction with these spark ignition systems to terminate fuel flow if the fuel is not ignited within a certain period of time. These systems also require a flame detection device to provide an indication to the timing circuit as to whether the fuel has been ignited. Such detection devices are costly to install and difficult to maintain.

Other direct ignition systems utilize glow plugs or igniter elements which are heated to the fuel ignition temperature and then used to ignite the fuel flowing from the burner. An inherent problem with these systems is that the electrical control circuits associated therewith are current responsive, and thus the fuel supply valve may be actuated prematurely if the igniter draws a larger current than desired before it reaches the ignition temperature of the fuel. Such a condition can be caused by design and manufacturing tolerance variations associated with the production of the igniter. Premature actuation creates a very unsafe condition since the fuel admitted to the burner will not be ignited and will be permitted to escape into the surrounding atmosphere.

SUMMARY OF THE INVENTION

The present invention provides a solution to the aforementioned problems of the thermocouple placement. flame sensing, and premature actuation of the fuel supply valve. This direct burner ignition system also conserves fuel since a pilot flame is not required.

In a preferred embodiment of the invention, a thermal switch is utilized to electrically bypass the actuating means for the fuel supply valve while the igniter is being heated to the ignition temperature of the fuel. The thermal switch is adjusted to operate only if a voltage sufficient to allow the igniter to reach the desired ignition temperature is present, thus preventing premature actuation of the fuel valve. When the thermal switch operates, the electrical bypass is removed and the fuel valve actuating means is energized, which after a time delay, allows the fuel valve to open permitting fuel to flow to the burner.

The thermal switch is temperature responsive and voltage sensitive, and thus insures that the fuel valve is not opened unless a sufficient source voltage is available to allow the igniter to reach the ignition temperature of the fuel.

DESCRIPTION OF THE PREFERRED EMBODIMENT

Figure 1:
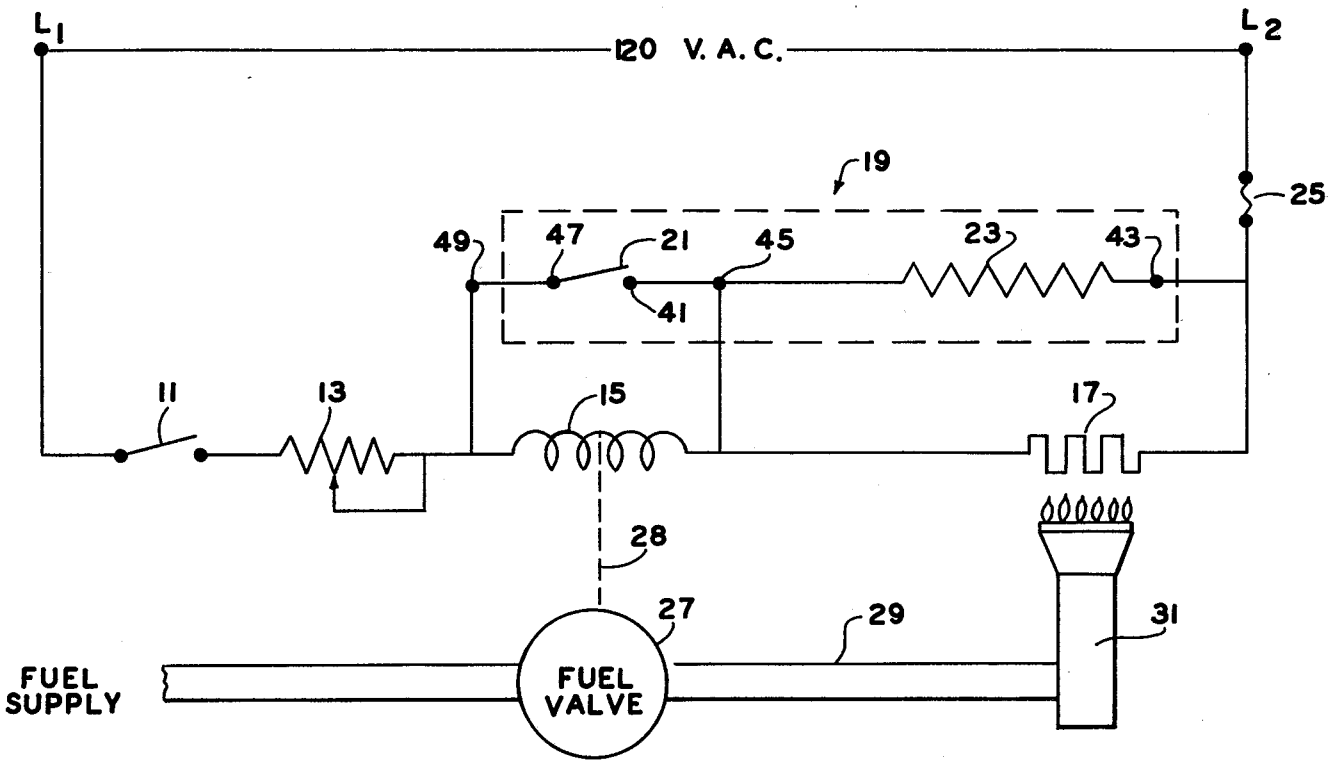
FIG. 1 is a schematic drawing of one embodiment of the direct ignition system.

Referring now to the drawings, FIG. 1 shows a 120 volt A.C. power source connected across a pair of lines $L_1$ and $L_2$. A thermostat switch 11, a trim resistor potentiometer 13, a fuel valve actuating coil 15, and an igniter 17 are connected in series across lines $L_1$ and $L_2$. Both the thermostat 11 and the trim resistor potentiometer 13 are of conventional design and construction and thus will not be described in detail herein. A thermal switch 19 comprising a set 21 of electric contacts and a precision heater 23 are also provided. Electrical contact set 21 is connected in parallel with the fuel valve actuating coil 15, and its associated precision heater 23 is connected in parallel with the igniter 17. A fuse 25 is provided in Line $L_2$ for overload protection. Fuel flow to the burner is controlled by a fuel valve 27 positioned in a conduit 29 between the fuel supply and a burner 31.

The fuel valve 27 is actuated by actuating coil 15 as is indicated by the dotted line 28. Such actuation will be described in further detail below. The igniter 17 is mounted proximately to the outlet of the burner 31 to allow the fuel from the burner 31 to flow directly onto the igniter 17 upon actuation of the fuel valve 27.

Figure 2:
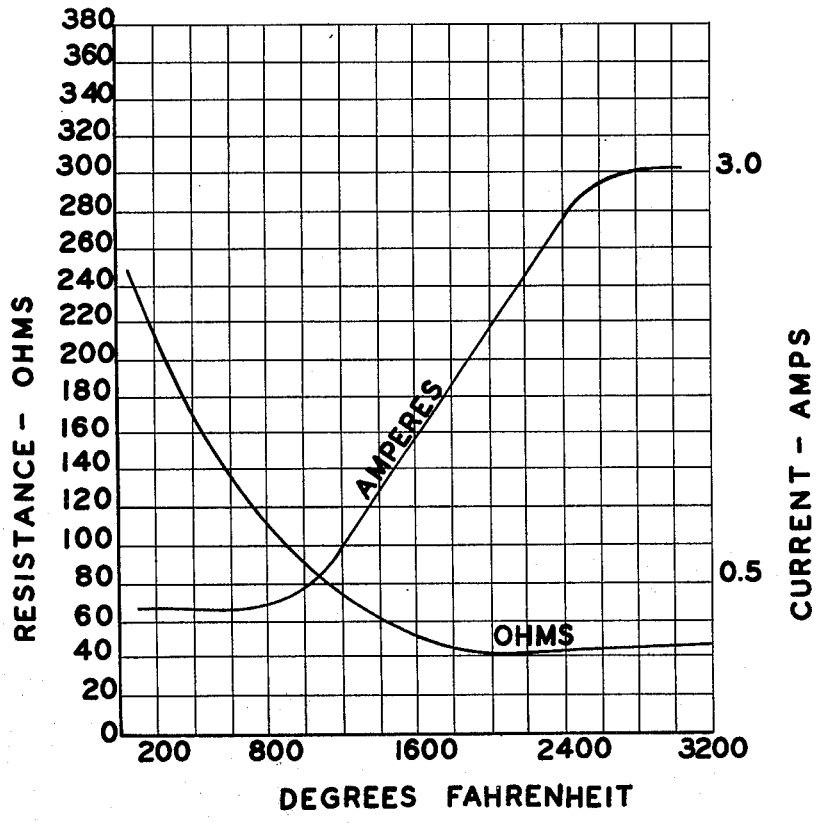
FIG. 2 is a graph of resistance of, and current flow through, the igniter versus igniter temperature.

Regarding the operating characteristics of the components involved, the igniter 17 is a negative slope thermistor which exhibits a decreasing electrical resistance with increasing temperature. As shown in FIG. 2, the igniter has a resistance of 240 ohms at an initial ambient temperature of 80° F. If 120 volts A.C. were applied to the igniter circuit at this temperature, a current of approximately 0.45 amps would flow therethrough. As current flows through the igniter, it increases in temperature which results in a corresponding decrease in resistance until the resistance starts leveling off, at approximately 1600° F., to an approximate value of 40 ohms at 2200° F. Similarly, current flow through the igniter increases and approaches an approximate value of 3 amps at 2200° F.

The fuel valve 27, as shown schematically in FIG. 1, is a temperature responsive bimetal device and is designed to be actuated and allow fuel flow to the igniter 17 when a current of at least 2.8 amps flows through its actuating coil 15. A current flow of this magnitude is possible only when the resistance of igniter 17 is approximately 40 ohms which occurs when the igniter temperature is approximately 2200° F. Therefore, the fuel valve permits fuel flow only when the igniter has reached or surpassed the ignition temperature of the fuel, such as natural gas which has an ignition temperature of approximately 1600° F., thus insuring the ignition of the gas when admitted to the burner.

Figure 4:
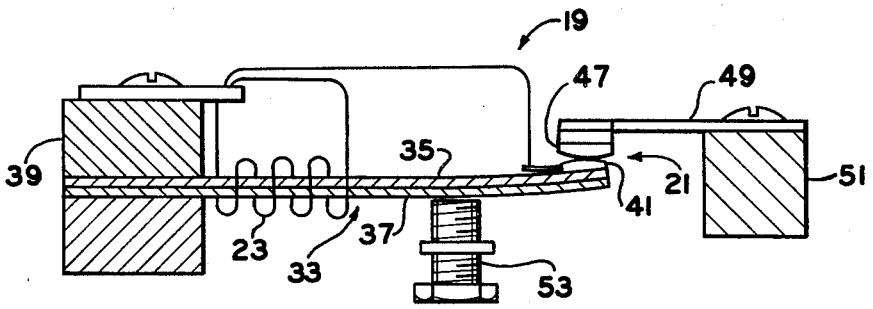
FIG. 4 is a cross-sectional side view of a thermal switch which may be used in the direct ignition system of the present invention.
Figure 5:
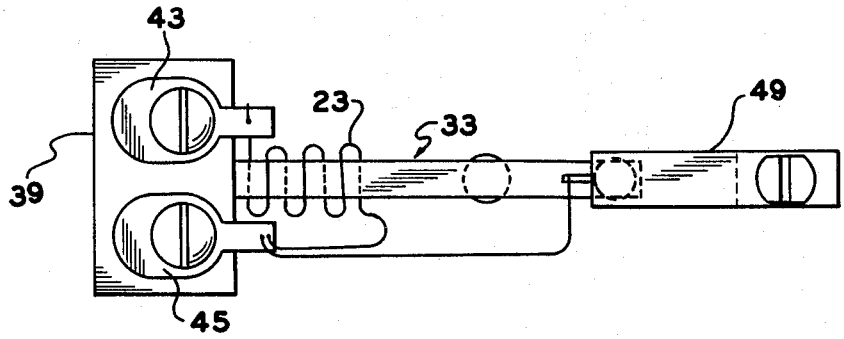
FIG. 5 is a top view of the thermal switch of FIG. 4

The thermal switch 19, as shown in FIGS. 4 and 5, is a temperature responsive and voltage sensitive bimetal device which has a set 21 of electrical contacts that open when an ambient compensated bimetal assembly 33 is heated to its actuation temperature by current flowing through the precision heater 23. The bimetal assembly 33 includes bimetal elements 35 and 37 which are joined by means known to those familiar with the art. One end of the bimetal assembly 33 is joined to an electrically insulated terminal block 39, while the other end has an electrical contact 41 attached thereto. The precision heater 23 is wrapped around the bimetal assembly 33 and has its ends connected to electrical terminals 43 and 45 which are mounted on the insulated terminal block 39. Electrical contact 41 is electrically connected to terminal 45. An electrical contact 47 is positioned to be in close proximity to electrical contact 41 and is attached to a terminal 49 mounted on a terminal block 51. Electrical contacts 41 and 47 comprise the electrical contact set 21. An adjustment screw 53 is provided so that mechanical pressure can be applied to the set 21 of electrical contacts to vary the switch actuation voltage. Since the actuation temperature is a function of current flowing through the precision heater 23, and current is a function of voltage, the turning of adjustment screw 53, in essence, varies the actuation voltage of the thermal switch 19. The thermal switch 19 is preferably adjusted to be operable only when a voltage of at least 95 volts A.C. has been applied to its terminals 43 and 45 for a period of time sufficient to permit the bimetal assembly 33 to be heated to a steady state condition by current passing through the precision heater 23. This adjustment can be made by applying 95 volts A.C. across terminals 43 and 45, allowing the bimetal assembly 33 to heat to a steady state condition, and then turning adjustment screw 53 until the set of electrical contacts opens. Other methods of calibration known to those skilled in the art can be used to insure that the electrical contact set 21 does not open unless 95 volts A.C. have been impressed across the thermal switch 19 for a sufficient period of time so that the bimetal assembly 33 can be heated to its steady state condition.

Figure 3:
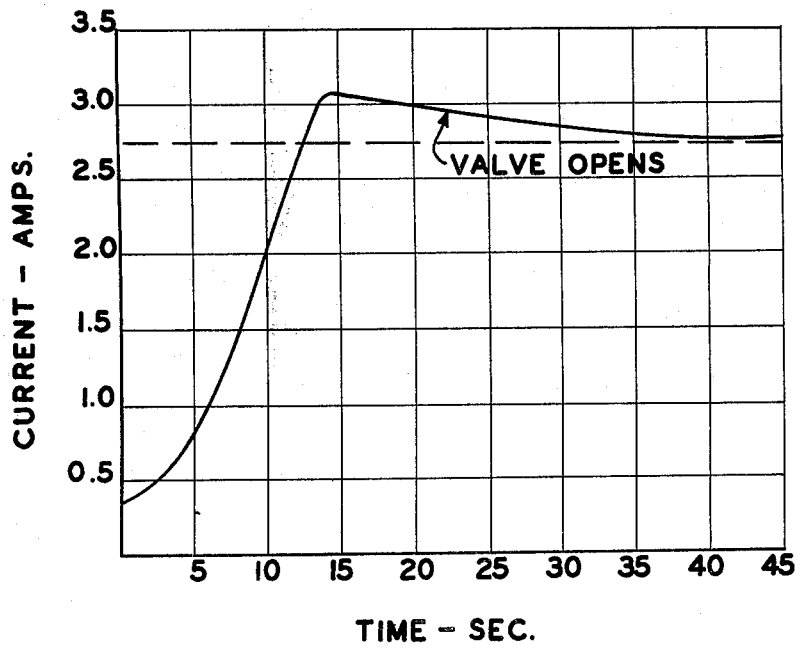
FIG. 3 is a graph of current flow through the igniter versus time after connection to a 120 volt A.C. power source.

Referring again to FIG. 1, when the thermostat switch 11 closes, the power source voltage across lines $L_1$ and $L_2$ is applied to the series circuit comprising the thermostat switch 11, trim resistor potentiometer 13, fuel valve actuating coil 15, igniter 17 and fuse 25. Actuating coil 15 does not open fuel valve 27 because the actuating coil 15 is short circuited by the electrical contact set 21 which is in its closed position. Since the resistances of the trim resistor potentiometer 13 and the fuse 25 are negligible compared to the resistances of the igniter 17 and the precision heater 23, almost all of the source voltage is impressed across the parallel connection of the igniter 17 and the precision heater 23. As previously stated, the current that flows through the igniter 17 is initially relatively low (0.45 amps) because of its high resistance (240 ohms) at an ambient temperature of 80° F. The current flow causes the temperature of the igniter to increase which results in a corresponding decrease in igniter resistance. Such a decrease in resistance, in turn, causes the current that passes through the igniter to increase. This increase in igniter temperature and current passing therethrough, as was previously explained, should result in an igniter current of about 3.0 amps at 2200° F. An igniter current of 3.0 amps would be sufficient to actuate fuel valve 27 since this valve is designed to actuate when a current of approximately 2.8 amps flows through its actuating coil 15. Such actuation is not possible, however, because the actuating coil 15 is bypassed by the set 21 of closed electrical contacts which will not open until the bimetal assembly 33 reaches its actuation temperature, and bimetal assembly 33 will not reach its actuation temperature unless 95 volts A.C. have been impressed across precision heater 23. When the bimetal assembly 33 does reach its actuation temperature, the electrical contact set 21 opens, permitting current to flow through the fuel valve actuating coil 15, however, fuel valve 27 does not open immediately. The time delay between the closing of thermostat switch 11 and the opening of fuel valve 27 is shown in the graph of FIG. 3. When the igniter is initially connected to the power source, approximately 13 seconds elapse before the current passing therethrough increases to 2.8 amps, the actuation current of the fuel valve 27. However, it takes approximately 8 seconds longer for the bimetal assembly within fuel valve 27 to reach its actuation temperature and open valve 27 allowing fuel to flow through conduit 29 to burner 31. This 8 second time delay insures that the igniter 17 has been heated to a temperature in excess of the ignition temperature of the fuel before the fuel valve 27 opens allowing fuel to enter the burner. Thus, this time delay prevents premature actuation of fuel valve 27 which could occur if the variations in design and manufacturing tolerances of the igniter were such as to permit the igniter to draw sufficient current to actuate fuel valve 27 before the igniter 17 reached the ignition temperature of the fuel.

In addition to preventing premature fuel valve actuation, the thermal switch 19 also prevents any actuation of fuel valve 27 if a significant voltage drop occurs in the power source. Since the thermal switch 19 is adjusted to operate at 95 volts A.C., if the source voltage drops significantly, 95 volts A.C. will not be sustained across terminals 43 and 45, and the set 21 of electrical contacts bypassing actuating coil 15 will not open. Thus, the actuation of fuel valve 27 is prevented under this low voltage condition. This is desirable because a low voltage condition could result in the igniter 17 not reaching the ignition temperature of the natural gas.

The operation of the thermal switch 19 is also fail-safe. If instead of a voltage drop, a power outage occurs, 95 volts A.C. will not be impressed across terminals 43 and 45 of thermal switch 19 and the set 21 of electrical contacts will close, bypassing actuating coil 15 which, in turn, will cause fuel valve 27 to close, stopping gas flow to burner 31.

After the gas flowing to the burner 31 is ignited by igniter 17, the burner heats the area or device that requires heating until the thermostat senses that the desired temperature has been attained. When this occurs, thermostat switch 11 opens which de-energizes the actuating coil 15 which, in turn, closes fuel valve 27 preventing further flow of gas to burner 31. Opening of thermostat switch 11 also de-energizes the thermal switch 19 which causes the set 21 of electrical contacts to close bypassing fuel valve actuating coil 15. Thus, the set 21 of electrical contacts is in the proper position for the subsequent heating of the igniter 17.

Figure 6:
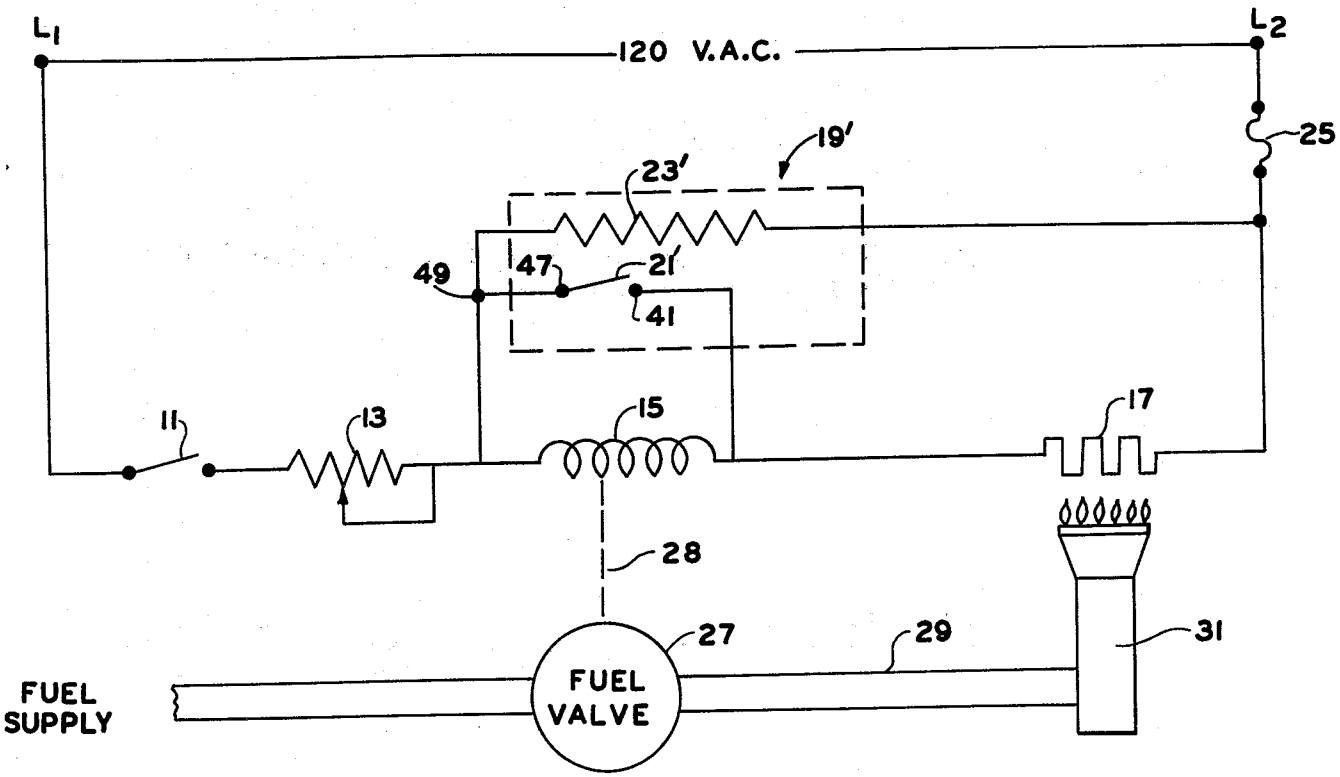
FIG. 6 is a schematic drawing of another embodiment of the direct ignition system.

Another embodiment of the direct ignition system is shown in FIG. 6. This embodiment differs from the aforementioned embodiment in the electrical connection of the thermal switch components relative to other control circuit components. In this embodiment, electrical contact set 21', associated with thermal switch 19', is again connected in parallel with the fuel valve actuating coil 15, but precision heater 23' is connected in parallel across the series connection involving fuel valve actuating coil 15 and igniter 17. The operation of this embodiment does not differ from the operation of the aforementioned embodiment, and thus will not be discussed.

Thermal switch 19 has many uses, but as employed in this direct ignition system, it insures that fuel will not be admitted to the burner 31 unless the source voltage is sufficient to permit the igniter 17 to reach the ignition temperature of the fuel. It also insures that fuel flow will continue only if the igniter temperature equals or exceeds the fuel ignition temperature. Thus, this direct ignition system is failsafe in operation.

Variations of the present invention will be apparent to those having ordinary skill in the art and the invention is limited only by the spirit and scope of the following claims.

I claim:

1. Electrical circuitry for controlling the operation of a fuel supply valve which regulates the flow of fuel to a direct ignition system fuel burner, said electrical circuitry comprising:

means for igniting said flow of fuel, said igniting means adapted to be mounted in promimity to said burner;

means for actuating said fuel supply valve, said valve actuating means being connected electrically in series with said igniting means; and thermal switch means including electrical heater means and switching means actuated by said electrical heater means, said electrical heater means being connected electrically in series with said switching means and connected electrically in parallel with said igniting means, said switching means being connected electrically in parallel with said valve actuating means and operable to shunt said valve actuating means until a predetermined minimum voltage has been applied to said electrical heater means for a period of time sufficient to permit said electrical heater means to be heated to a steady state condition, said predetermined minimum voltage being of sufficient magnitude to heat said igniting means to the ignition temperature of said fuel during the time said electrical heater means is being heated to said steady state condition.

2. Electrical circuitry for controlling the operation of a fuel supply valve which regulates the flow of fuel to a direct ignition system fuel burner, said electrical circuitry comprising:

means for igniting said flow of fuel, said igniting means adapted to be mounted in proximity to said burner;

means for actuating said fuel supply valve, said valve actuating means being connected electrically in series with said igniting means; and thermal switch means including electrical heater means and switching means actuated by said electrical heater means, said electrical heater means being connected electrically in parallel with said electrical series connection of said igniting means and said valve actuating means, said switching means being connected electrically in parallel with said valve actuating means and operable to shunt said valve actuating means until a predetermined voltage has been applied to said electrical heater means for a period of time sufficient to permit said electrical heater means to be heated to a steady state condition, said predetermined minimum voltage being of sufficient magnitude to heat said igniting means to the ignition temperature of said fuel during the time said electrical heater means is being heated to said steady state condition.

3. A direct ignition system for a fuel burner comprising:

a fuel valve including actuating means attached thereto, said fuel valve being fluidically connected between a fuel supply and said burner to control the flow of fuel to said burner;

igniting means mounted in proximity to said burner, said igniting means being connected electrically in series with said valve actuating means; and thermal switch means including electrical heater means and switching means actuated by said electrical heater means, said electrical heater means being connected electrically in series with said switching means and connected electrically in parallel with said igniting means, said switching means being connected electrically in parallel with said valve actuating means and operable to shunt said valve actuating means preventing said actuating means from opening said fuel valve until a predetermined voltage has been applied to said electrical heater means for a period of time sufficient to permit said electrical heater means to be heated to a steady state condition, said predetermined minimum voltage being of sufficient magnitude to heat said igniting means to the ignition temperature of said fuel during the time said electrical heater means is being heated to said steady state condition.

4. A direct ignition system for a fuel burner comprising:

a fuel burner including actuating means attached thereto, said fuel valve being fluidically connected between a fuel supply and said burner to control the flow of fuel to said burner;

igniting means mounted in proximity to said burner, said igniting means being connected electrically in series with said valve actuating means; and thermal switch means including electrical heater means and switching means actuated by said electrical heater means, said electrical heater means being connected electrically in parallel with said electrical series connection of said igniting means and said valve actuating means, said switching means being connected electrically in parallel with said valve actuating means preventing said actuating means from opening said fuel valve until a predetermined voltage has been applied to said electrical heater means for a period of time sufficient to permit said electrical heater means to be heated to a steady state condition, said predetermined minimum voltage being of sufficient magnitude to heat said igniting means to the ignition temperature of said fuel during the time said electrical heater means is being heated to said steady state condition.

5. A direct ignition system for a fuel burner comprising:

valve means including actuating means attached thereto, said valve means controlling the flow of fuel to said burner;

means for igniting said flow of fuel, said igniting means being connected electrically in series with said valve actuating means; and thermal switch means connected electrically to said series connection of said valve actuating means and said igniting means, said thermal switch means being operable to prevent said valve actuating means from opening said valve means until said igniting means reaches the ignition temperature of said fuel, said thermal switch means comprising electrical heater means having a substantially constant electrical resistance, switching means actuated by said electrical heater means, said switching means being connected electrically to said electrical heater means and being operable to shunt said valve actuating means preventing said valve actuating means from opening said valve means until a predetermined minimum voltage has been applied to said electrical heater means for a period of time sufficient to permit said electrical heater means to be heated to a steady state condition, said predetermined voltage being substantially applied simultaneously to said igniting means and being of such magnitude to heat said igniting means to the ignition temperature of said fuel, and means for adjusting said switching means to be operable only if said predetermined minimum voltage is present.

6. A direct ignition system for a fuel burner comprising:

valve means including actuating means attached thereto, said valve means controlling the flow of fuel to said burner;

means for igniting said flow of fuel, said igniting means being connected electrically in series with said valve actuating means; and thermal switch means connected electrically to said series connection of said valve actuating means and said igniting means, said thermal switch means being operable to prevent said valve actuating means from opening said valve means until said igniting means reaches the ignition temperature of said fuel, said thermal switch means comprising electrical heater means having a substantially constant electrical resistance, switching means actuated by said electrical heater means, said switching means being connected electrically to said electrical heater means and being operable to shunt said valve actuating means preventing said valve actuating means from opening said valve means until a predetermined minimum voltage has been applied to said electrical heater means for a period of time sufficient to permit said electrical heater means to be heated to a steady state condition, said predetermined voltage being substantially applied simultaneously to said igniting means and being of such magnitude to heat said igniting means to the ignition temperature of said fuel, and means for adjusting said switching means to be operable only if said predetermined minimum voltage is present, said electrical heater means being connected electrically in parallel with said igniting means and said switching means being connected electrically in series with said electrical heater means and being connected electrically in parallel with said valve actuating means.

7. A direct ignition system for a fuel burner comprising:

valve means including actuating means attached thereto, said valve means controlling the flow of fuel to said burner;

means for igniting said flow of fuel, said igniting means being connected electrically in series with said valve actuating means; and thermal switch means connected electrically to said series connection of said valve actuating means and said igniting means, said thermal switch means being operable to prevent said valve actuating means from opening said valve means until said igniting means reaches the ignition temperature of said fuel, said thermal switch means comprising electrical heater means having a substantially constant electrical resistance, switching means actuated by said electrical heater means, said switching means being connected electrically to said electrical heater means and being operable to shunt said valve actuating means preventing said valve actuating means from opening said valve means until a predetermined minimum voltage has been applied to said electrical heater means for a period of time sufficient to permit said electrical heater means to be heated to a steady state condition, said predetermined voltage being substantially applied simultaneously to said igniting means and being of such magnitude to heat said igniting means to the ignition temperature of said fuel, and means for adjusting said switching means to be operable only if said predetermined minimum voltage is present, said electrical heater means being connected electrically in parallel with said electrical series connection of said igniting means and said valve actuating means and said switching means being connected electrically in parallel with said valve actuating means.

* * * * *